United States Patent [19]

Howton et al.

[11] Patent Number: 4,841,356

[45] Date of Patent: Jun. 20, 1989

[54] FUSES AND THEIR MANUFACTURE

[75] Inventors: Kenneth D. Howton, Palatine; Robert G. Stewart, Lake Villa; Herman R. Zeitler, Mount Prospect, all of Ill.

[73] Assignee: Brush Fuses, Inc., Des Plaines, Ill.

[21] Appl. No.: 177,637

[22] Filed: Apr. 5, 1988

[51] Int. Cl.[4] ..... H01H 85/14; H01H 85/04

[52] U.S. Cl. ..... 337/248; 29/623; 337/251; 337/158

[58] Field of Search ..... 337/248, 249, 250, 251, 337/268, 269, 158, 159, 276, 228, 237; 29/619, 621, 623

[56] References Cited

U.S. PATENT DOCUMENTS 1,101,847 6/1914 Alexander ..... 337/248

2,659,790 11/1953 Jurgensen ..... 337/248

4,063,208 12/1977 Bernatt ..... 337/248

*Primary Examiner*—H. Broome

[57] ABSTRACT

The disclosed fuse has a tube of insulation, terminals at the ends of the tube, a link connecting the terminals, and a granular filler. At least one end cap is made of sheet metal which has one or more integrally extending tabs and a respective hole for each tab, each tab and its hole having the same size and shape. Granular fill is introduced via said hole(s) while the tab(s) are raised to provide wide openings. The end cap is sealed by driving the tab(s) into the hole(s). After the fuse contains granular filler but before driving the tab(s) into the hole(s), the fuse may be impregnated with a fluid, first adjusting the tab(s) to be narrowly open to retain the granular filler while admitting the impregnant.

9 Claims, 1 Drawing Sheet

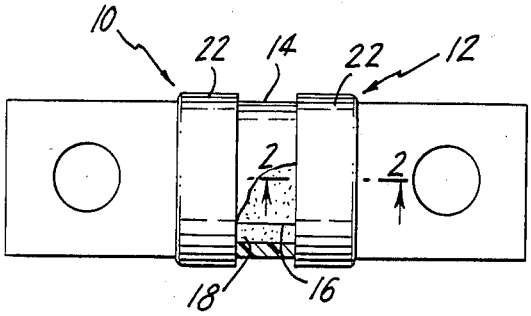
FIG. 1
FIG. 2
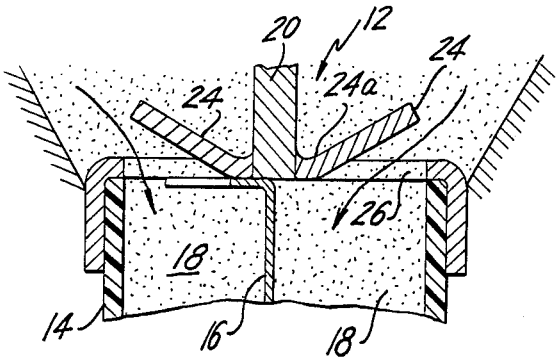
FIG. 5
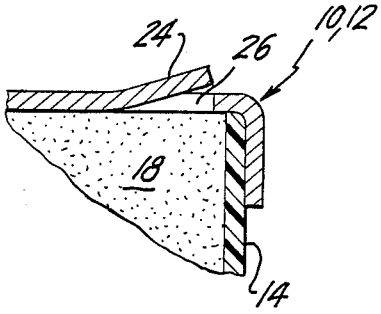
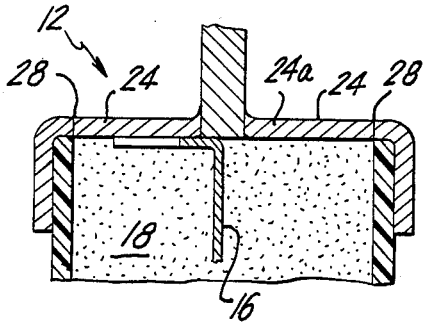
FIG. 3
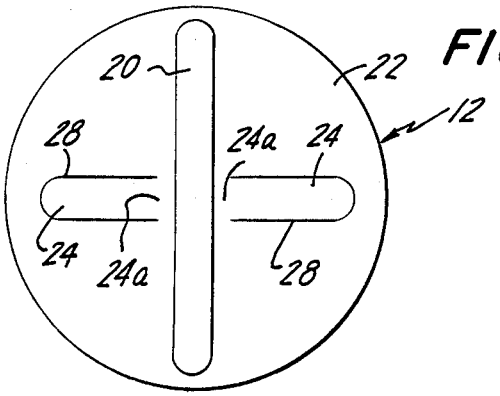
FIG. 4

FUSES AND THEIR MANUFACTURE

The present invention relates to electrical fuses, of the type having an enclosure containing a fuse link in an arc extinguishing filler.

A type of fuse that has been produced for many decades involves a tube of insulation, terminals closing the opposite ends of the tube, a fusible link within the tube connecting the terminals, and sand or other granular arc quenching material in the tube packed around the fuse link. In making the fuse, an assembly is prepared comprising the tube and the terminals and the link. Granular filler is introduced into the fuse through a hole or holes in one of the terminals. The assembled unit is vibrated to promote thorough filling and packing of the filler throughout. Metal plugs are driven into the holes for sealing the enclosure.

A well known form of terminal involves a sheet-metal end cap and a projecting terminal blade, or the terminal may consist of an end cap alone in the form of a ferrule. The end cap is made of sheet-metal. After the fuse has been fully packed with sand, a cavity must be formed at the filling hole(s) to receive each plug. If too little sand is removed, handling and insertion of each plug is difficult, whereas removing too much sand allows the sand to shift and the packing density of the sand could suffer. Moreover, each plug is a tiny part which is hard to hold in place while forcing it into the hole.

Fuses having links in packed sand are known, in which a silicate forms a binder for the sand. The silicate is introduced into a fuse via its sand full hole(s) as a fluid, i.e., water hglass, and then dried.

The present invention greatly facilitates closing the filling holes of a fuse's end cap, and avoids the guesswork heretofore involved in clearing a cavity that is to receive a portion of the plug that extends into the filler. A distinctive end cap is provided at least at that end of the fuse where granular fill is introduced. That end cap is formed with integral means for sealing the filling hole(s), i.e., a tab or tabs, lanced incompletely out of the sheet metal end cap. A hole remains opposite each raised tab that matches the size and shape of the opposite tab, and each tab remains securely aligned with its opposite hole. After an assembled unit is prepared, comprising a tube, a fuse link and two terminals, at least one terminal having the distinctive end cap, the assembled unit is filled with granular filler as heretofore. Then the filler remaining on the end cap is brushed away, and each tab is driven into its opposite congruent hole. Only a gentle hammer blow or a stroke of a press is needed to drive each tab into its opposite hole. The integral connection of each tab to the sheet metal end cap controls the orientation of the tab while it is being struck or pressed. While a small volume of filler may initially remain in the space that is finally occupied by each tab, that space is quite small and any residual filler in that space is evidently crushed to powder and driven into the voids of the nearby granular filler. Each tab becomes permanently edge-locked in position for dependably containing the granular filler and forming a permanent secure seal against foreign materials entering the fuse.

The raised tabs provide a further distinctive purpose. Pursuant to a prior practice, a binder can be introduced into the sand as a fluid after the sand has been densely packed in the fuse as described above utilizing holes in the fuse's end caps in the impregnation process. End caps formed with lanced tabs are uniquely useful for that purpose. The tab or each tab of one end cap can be formed or adjusted so that it is narrowly open for entry of fluids, but closed against the escape of sand or other granular fill. A fuse may be placed upright and packed with sand, using a lower end cap with the narrowly open tabs and an upper-end cap with open tabs to admit sand. The fuse may then be impregnated with a fluid, first adjusting the previously open tabs to be narrowly open for containing the sand filler and for allowing penetration by the impregnant. Finally, all the tabs are driven to their fully closed condition.

The invention and its further advantages and novel aspects will be best appreciated from the accompanying drawings which illustrate a presently preferred embodiment and from the following detailed description of that embodiment.

In the drawings:

FIG. 1 is a typical fuse utilizing the features of the invention;

FIG. 2 is an enlarged fragmentary cross-section of the fuse of FIG. 1 as seen at the plane 2—2 of FIG. 1 when the fuse is being filled with granular arc-quenching material;

FIG. 3 is an enlarged fragmentary view corresponding to FIG. 2, with the fuse in its completed condition;

FIG. 4 is an enlarged view of the left-hand end of the fuse of FIG. 1; and FIG. 5 is a fragmentary detail of FIG. 2 in a modified condition.

Referring now to the drawings, the fuse shown in FIG. 1 includes end terminals 10 and 12 mechanically secured to end portions of insulating tube 14. A fuse link 16 inside tube 14 interconnects terminals 10 and 12. Granular arc-quenching material 18, being sand in this example, fills the interior of the fuse around link 16.

Terminals 10 and 12 are of the blade-and-end-cap type. FIG. 3 represents terminal 12 in its condition as part of the finished fuse of FIG. 1. That view shows terminal 12 as consisting of two parts, a contact blade 20 and an end cap 22 of sheet metal. As seen in FIGS. 3 and 4, tabs 24—which are integral portions of the sheet metal of end cap 22—are edge-locked in holes in the end cap.

FIG. 2 shows tabs 24 raised away from the surrounding area of the end cap and projecting externally. End cap 22 is formed of sheet metal, and tabs 24 are incompletely lanced out of the end cap, leaving an integral connection 24*a*. Each tab, being of sheet metal, is much thinner than its width or its length. The outline of tab 24 matches the size and shape of hole 26 (FIG. 2), as results from forming the tab by a lancing operation. That outline 28 appears in FIGS. 3 and 4.

The fuse is made by conventionally assembling the terminals 10 and 12 to the ends of tube 14. One end of fuse link 16 is soldered to one terminal before the tube is in place and the opposite end of fuse link 16 is soldered to the other terminal after the parts are assembled.

Granular fill, sand in this example, is deposited on end cap 12 and, as the fuse and the overlying fill is vibrated, the fill enters and becomes packed throughout the interior of the fuse. San remaining on the exterior is brushed away. Using a hammer or a press, the raised tabs are forced to return to the space they occupied before the lancing operation. Some sand may be disposed under the raised tabs. Part of that underlying sand is brushed away easily. The remaining part of that sand under each tab is pulverized as the tab is forced into its sealing position of FIG. 3. The crushed sand and the sand fill close to the tab become compacted locally. This completion of a fuse after being charged with filler is a wholly non-critical virtually effortless operation.

The same form of end cap 22 in FIGS. 2 and 4 can be provided at both ends of the fuse. It is useful to do so when the sand-filled fuse is to be impregnated with a liquid. For that purpose, the tabs 24 of terminal 10 (see FIG. 5) are driven partway toward closed condition so that gaps remain for later use during impregnation, while blocking the escape of sand. Tabs 24 of terminal 12 can be left fully open, for admitting sand as described above. Tabs 24 at terminal 12 can then be driven partway back toward the stratum of the surrounding end-cap sheet metal for preventing grains of sand from escaping via terminal 12, yet remaining narrowly open for the impregnation process. The same gaps in both terminals 10 and 12 serve as passages for escape of vaporized vehicle that develops when the fuse is being kiln-dried after being impregnated. The tabs 24 at both ends of the fuse are finally driven into their edge-locked condition as represented in FIG. 4, to complete the fuse.

The above-described procedure of impregnating and then kiln-drying the sand may be used to provide the sand with a material that modifies its arc quenching performance, for example a silicate binder. The lanced tabs in the end caps, used as described, greatly facilitate that procedure.

The foregoing represents illustrative applications of the invention in its various novel aspects, all of which is subject to varied modification by those skilled in the art. Consequently, the appended claims should be construed broadly in accordance with the full spirit and scope of the invention.

What is claimed is:

1. The method of making a fuse containing arc quenching material including the steps of (a) forming at least one end cap with open sealing means comprising one or more raised tabs lanced incompletely out of the rest of the end cap and thereby forming a hole opposite the tab having an edge that matches the outline of the tab, (b) assembling elements of a fuse including a tube of insulation, terminals at the ends of the tube, and a link interconnecting said terminals, at least one of said terminals including an end cap formed as set forth above with its tab or tabs projecting externally, (c) introducing arc quenching material into said tube via said open sealing means, and (d) driving the tab or each of the tabs of said end cap into its opposite hole so as to close said hole.

2. The method of making a fuse as in claim 1, wherein the arc quenching material of step (c) includes a granular filler and the sealing means is initially open sufficiently for the granular filler to enter the fuse, including the further steps of (i) driving said tab or each said tab toward its hole so as to leave at least one narrow passage for penetration by fluid impregnant, and (ii) impregnating said granular fill with a fluid via said narrow passage, thereafter driving the tab or each of the tabs into its opposite hole as aforesaid so as to close said narrow passage.

3. The method of making a fuse containing granular arc quenching material including the steps of (a) assembling elements of a fuse including a tube of insulation, first and second terminals at the ends of the tube and a link interconnecting said terminals, each of said terminals comprising a sheet-metal end cap having one or more externally projecting tabs opposite to holes that are congruent to the tabs, respectively, said tab or tabs of said first terminal being raised amply for admitting granular filler into the tube and said tab or tabs of the second terminal being narrowly open for confining said granular filler while allowing entry and exit of fluid, (b) introducing granular arc quenching material into said tube past the tab or tabs of said first terminal, (c) driving the tab or tabs of the first terminal to be narrowly open, (d) treating the granular material in the tube with fluid by at least introducing impregnating liquid via at least one of said narrowly open tabs, and (e) driving said tabs into their respective congruent holes.

4. A cartridge fuse including a tube of insulation, first and second terminals at the ends of said tube and a link inter-connecting said terminals, at least one of said terminals comprising an end cap of sheet metal having at least one tab congruent to and aligned with a hole in the end cap, the tab and the area of the end cap in which the hole is formed being continuously interconnected portions of the sheet metal of the end cap.

5. A cartridge fuse as in claim 4, wherein said tab is raised externally of the fuse so as to leave an opening for admitting granular arc quenching material.

6. A cartridge fuse as in claim 4 containing a granular filler, wherein said tab is raised externally of the fuse so as to leave a narrow passage for containing granular filler while providing a passage penetrable by fluid impregnant.

7. A cartridge fuse as in claim 4, wherein said tab is received in said hole in edge-to-edge locked condition.

8. A cartridge fuse as in claim 4 wherein said second terminal includes a second end cap of sheet metal having at least one tab congruent to and aligned with a hole in the second end cap, said tab and the area of said second end cap in which the hole is formed being continuously interconnected portions of the sheet metal of said second end cap.

9. A cartridge fuse as in claim 8 wherein said tab of the first-mentioned end cap is raised amply for admitting granular arc quenching material and said tab of the second end cap is sufficiently open for entry and exit of fluid while being closed against escape of granular arc quenching material.

* * * * *